United States Patent [19]

Martin et al.

[11] Patent Number: 4,883,941

[45] Date of Patent: Nov. 28, 1989

[54] FILAMENT WOUND FOIL FUSING SYSTEM

[75] Inventors: Robert G. Martin, Rochester; Paul C. Swanton, Webster, both of N.Y.

[73] Assignee: Xerox Corporation, Stamford, Conn.

[21] Appl. No.: 893,852

[22] Filed: Aug. 6, 1986

[51] Int. Cl.[4] ..... H05B 1/00

[52] U.S. Cl. ..... 219/216

[58] Field of Search ..... 219/216, 469, 471; 355/3 FU, 14 FU

[56] References Cited

U.S. PATENT DOCUMENTS

| | | | |
|---|---|---|---|
| 3,256,002 | 6/1966 | Hudson | 263/3 |
| 3,268,351 | 8/1966 | Van Dorn | 117/21 |
| 3,471,683 | 10/1969 | Bogue | 219/469 |
| 3,498,596 | 3/1970 | Moser | 263/6 |
| 3,649,810 | 3/1972 | Tsuboi et al. | 219/216 |
| 3,666,447 | 5/1972 | Saubaster | 75/108 |
| 3,669,706 | 6/1972 | Sanders et al. | 117/21 |
| 3,874,892 | 4/1975 | McInally | 117/6 |
| 3,898,424 | 8/1975 | Thettu | 219/216 |
| 3,948,214 | 4/1976 | Thettu | 118/60 |
| 3,953,709 | 4/1976 | Elter | 219/216 |
| 4,075,455 | 2/1978 | Kitamura et al. | 219/216 |
| 4,304,985 | 12/1981 | Miller | 219/216 |
| 4,355,255 | 10/1982 | Jaffe & Herr | 310/254 |
| 4,395,109 | 7/1983 | Nakajiama et al. | 355/3 FU |
| 4,518,845 | 5/1985 | Svendsen | 219/216 |

FOREIGN PATENT DOCUMENTS

| | | | |
|---|---|---|---|
| 0030158 | 3/1981 | Japan | 355/14 FU |

*Primary Examiner*—A. D. Pellinen
*Assistant Examiner*—Jeffrey A. Gaffin
*Attorney, Agent, or Firm*—Ronald F. Chapuran

[57] ABSTRACT

An instant-on fuser having a cylindrical, relatively thin fiber wound cylinder supporting a resistance wire, heating foil, or printed circuit secured on the outside surface of the cylinder or embedded to the surface of the cylinder. The interior of the cylindrical tube is filled with air, and the wire, heating foil or printed circuit is connected to electrical leads extending through caps on the ends of the cylindrical support. The fuser is fabricated from the cylinder outward to the final step of applying a release agent on the outer surface.

2 Claims, 3 Drawing Sheets

FILAMENT WOUND FOIL FUSING SYSTEM

This invention relates to an improved fuser apparatus, and more particularly to a filament wound foil fusing system.

BACKGROUND OF THE INVENTION

In order to fuse electroscopic toner material permanently onto a support surface by heat, it is usually necessary to elevate the temperature of the toner material to a point at which the constituents of the toner materials coalesce and become tacky. This heating causes the toner to flow to some extent into the fibers or pores of the support member. Thereafter, as the toner material cools, solidification of the toner material causes the toner material to become firmly bonded to the support member.

The use of thermal energy for fixing toner images onto a support member is well known. Several approaches to thermal fusing of electroscopic toner images have been described in the prior art. These methods include providing the application of heat and pressure substantially concurrently by various means, for example, a roll pair maintained in pressure contact, a flat or curved plate member in pressure contact with a roll, and a belt member in pressure contact with a roll.

Heat may be applied by heating one or both of the rolls, plate members or belt members. The fusing of the toner particles takes place when the proper combination of heat, pressure and contact time are provided. Typically, in such direct contact systems, the roller surface may by dry, i.e. no application of a release agent to the surface of the roller as described, for example, in U.S. Pat. Nos. 3,498,596 and 3,666,447. Alternatively, the fuser roll surface may be wetted with a release agent such as a silicone oil as described in U.S. Pat. Nos. 3,268,351 and 3,256,002. It is also known in the art to fuse toner images by the use of a flash fusing process, for example, as disclosed in U.S. Pat. No. 3,874,892. In such a process, a flash lamp is generally pulsed on for a very short period of time. It can be appreciated that since the lamp is pulsed or flashed for short period of time, a large amount of power must be used to accomplish the fusing of the toner particles.

Another method for fusing toner images to a substrate is radiant fusing. Radiant fusing differs from flash fusing in that in radiant fusing, the radiant energy source, typically and infrared quartz lamp, are turned on during the entire fusing step rather than pulsed for a short period of time as in flash fusing. Examples of radiant fuser apparatus are shown in U.S. Pat. Nos. 3,898,424 and 3,953,709. Such prior art radiant fusers are generally made of relatively heavy metallic construction which requires the constant use of a heating element to maintain the apparatus at standby temperature. U.S. Pat. No. 3,471,683 shows a heater roll with a printed circuit heating element. However, the heater roll is relatively thick and the adhesive material not suitable for relatively high temperature operation.

Such prior art fusing systems have been effective in providing the fusing of many copies in relatively large, fast duplicating machines, in which the use of standby heating elements to maintain the machine at or near its operating temperature can be justified. However, there is a continuing need for an instant-on fuser which requires no standby power for maintaining the fuser apparatus at a temperature above the ambient. It is known to use a positive characteristic thermistor having a self temperature controlling property as a heater for a heating roller. The roller is regulated to a prescribed temperature by a heating control temperature detection element. It is known to employ radiation absorbing materials for the fuser roll construction to effect faster warm-up time as described in U.S. Pat. No. 3,669,706. It is also disclosed in U.S. Pat. No. 4,355,255 to use an instant-on radiant fuser apparatus made of a low mass reflector thermally spaced from a housing, with the housing and the reflector together forming a conduit for the passage of cooling air therein. A low mass platen is provided which is constructed to achieve an operating temperature condition in a matter of a few seconds without the use of any standby heating device. It is also known as disclosed in U.S. Pat. No. 3,948,214 to use a cylindrical member having a first layer made of elastomeric material for transporting radiant energy, a second layer for absorbing radiant energy, and a third layer covering the second layer to affect a good release characteristic on the fuser roll surface. The fuser roll layers are relatively thin and have an instant-start capability. U.S. Pat. No. 4,395,109 discloses an instant-on fuser having a core of metal or ceramic supporting a fuser roller, and including a heat insulating layer, an electrically insulating layer and a protective layer formed on the outer circumference of the core.

A difficulty with the prior art fusing systems is that they are often relatively complex and expensive to construct and/or the mass of the system is relatively large to preclude an instant-start fusing capability. Another difficulty is that prior art fuser rolls are not always easily adapted to provide sufficient mechanical strength depending upon the size of paper to be fused or able to be tailored to selectively fuse different size copy sheets. It is an object of the present invention, therefore, to provide a new and improved instant-on fusing apparatus. It is another object of the present invention to provide an instant-on fuser apparatus that has a relatively low thermal mass and is designed for relatively ease of construction. It is another object of the present invention to provide a relatively high mechanical strength instant-on fuser roll regardless of the size of the copy sheet to be fused and to provide a fuser roll that can selectively fuse different size copy sheets.

Further objects and advantages of the present invention will become apparent as the following description proceeds and the features of novelty characterizing the invention will be pointed out with particularity in the claims annexed to and forming a part of this specification.

SUMMARY OF THE INVENTION

The present invention is concerned with an instant-on fuser having a cylindrical, relatively thin fiber wound cylinder supporting a resistance wire, heating foil, or printed circuit secured on the outside surface of the cylinder or embedded to the surface of the cylinder. The interior of the cylindrical tube comprises ambient air, and the wire, heating foil or printed circuit is connected to electrical leds extending through caps on the ends of the cylindrical support. The fuser is fabricated from the cylinder outward to the final step of applying a release agent on the outer surface.

BRIEF DESCRIPTION OF THE DRAWINGS

For a better understanding of the present invention, reference may be had to the accompanying drawings, wherein the same reference numerals have been applied to like parts and wherein.

DESCRIPTION OF THE INVENTION

Figure 1:
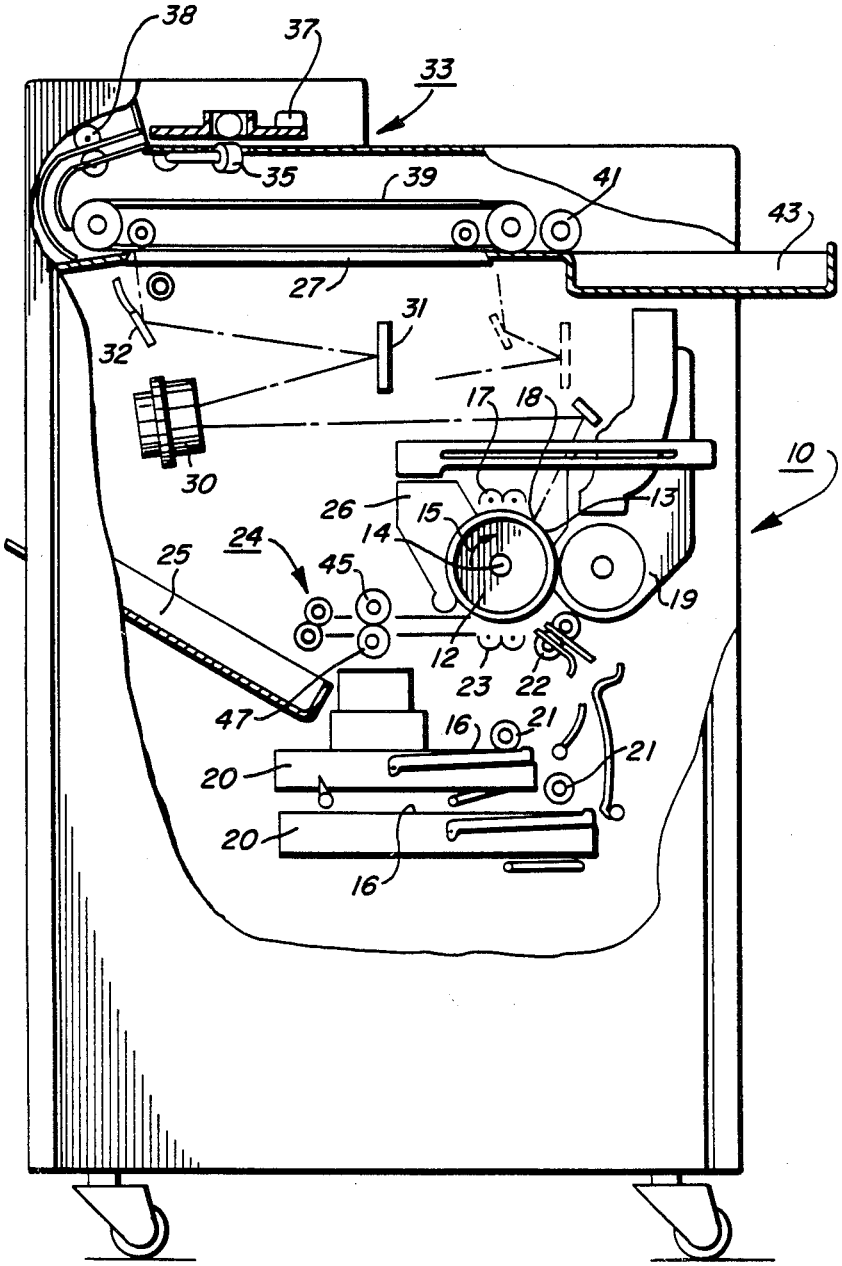
FIG. 1 is an illustration of a reproduction machine incorporating the present invention.

Referring now to FIG. 1, there is shown by way of example an automatic xerographic reproducing machine 10 including an image recording drum-like member 12, its outer periphery coated with suitable photoconductive material or surface 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input information is recorded upon a sheet of final support material or copy sheet 16.

Initially, the drum 12 moves the photoconductive surface 13 through a charging station 17 providing an electrostatic charge uniformly over the photoconductive surface 13 in known manner preparatory to imaging. Thereafter, the drum 12 is rotated to exposure station 18 and the charged photoconductive surface 13 is exposed to a light image of the original document to be reproduced. The charge is selectively dissipated in the light exposed regions to record the original document in the form of an electrostatic latent image. After exposure drum 12 rotates the electrostatic latent image recorded on the photoconductive surface 13 to development station 19 wherein a conventional developer mix is applied to the photoconductive surface 13 of the drum 12 rendering the latent image visible. Typically, a suitable development station could include a magnetic brush development system utilizing a magnetizable developer mix having coarse ferromagnetic carrier granules and toner colorant particles.

The copy sheets 16 of the final support material are supported in a stack arrangement on an elevatiing stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16.

After the toner image has been transferred to the sheet of final support material or copy sheet 16, the copy sheet 16 with the image is advanced to fusing station 24 for coalescing the transferred powder image to the support material. After the fusing process, the copy sheet 16 is advanced to a suitable output device such as tray 25.

Although a preponderance of toner powder is transferred to the copy sheet 16, invariably some residual toner remains on the photoconductive surface 13. The residual toner particles remaining on the photoconductive surface 13 after the transfer operation are removed from the drum 12 as it moves through a cleaning station 26. The toner particles may be mechanically cleaned from the photoconductive surface 13 by any conventional means, as for example, by the use of a cleaning blade.

Normally, when the copier is operated in a conventional mode, the original document to be reproduced is placed image side down upon a horizontal transparent platen 27 and the stationary original then scanned by means of a moving optical system. The scanning system includes a stationary lens 30 and a pair of cooperating movable scanning mirrors, half rate mirror 31 and full rate mirror 32 supported upon suitable carriages.

A document handler 33 can also be provided including registration assist roll 35 and switch 37. When a document is inserted, switch 37 activates registration assist roll 35 and the document is fed forward and aligned against a rear edge guide of the document handler 33. The pinch rolls 38 are activated to feed a document around 180° curved guides onto the platen 27 for copying. The document is driven by a platen belt transport including platen belt 39. After copying, the platen belt 39 is activated and the document is driven off the platen by the output pinch roll 41 into the document catch tray 43.

The fusing station 24 includes a heated fuser roll 45 and a back-up or pressure roll 47 forming a nip through which the copy sheets to be fused are advanced. The copy sheet is stripped from the fuser rolls by suitable (not shown) stripper fingers. The pressure roll 47 comprises a rotating member suitably journaled for rotation about a shaft and covered with an elastomeric layer of silicone rubber PFA or any other suitable material. The fuser roll 45 comprises a rotating cylindrical member 48 mounted on a pair of end caps 49 as seen in FIGS. 2 and 3.

To be instant-on, a fuser should achieve operating temperatures in a time shorter than the arrival time of the paper at the fuser, at machine start-up, approximately a 5–10 second warm-up time. This is, assume a copy sheet 16 takes from 5–10 seconds to be transported from the support tray 20 to the transfer station 23 to fuser 24 after a start print or start copy button is pushed. It is usually then necessary for the fuser to be elevated at least 120° C. The temperature rise is of the order of a 120° C. to 16° C. for a roller-type fuser. Raising the temperature of a rigid structure at a change of temperature of approximately 120°–160° C. in five seconds using reasonable power levels, for example, 700 watts, requires a small mass to be heated. In accordance with the present invention, the cylindrical member 48 is a hollow cylinder of fiber glass, carbon graphite, or boron carbide fibers or any other suitable fiber material of suitable mechanical strength. Preferably, the thickness of the cylindrical member 48 wall is approximately 20–40 mils.

Figure 2:
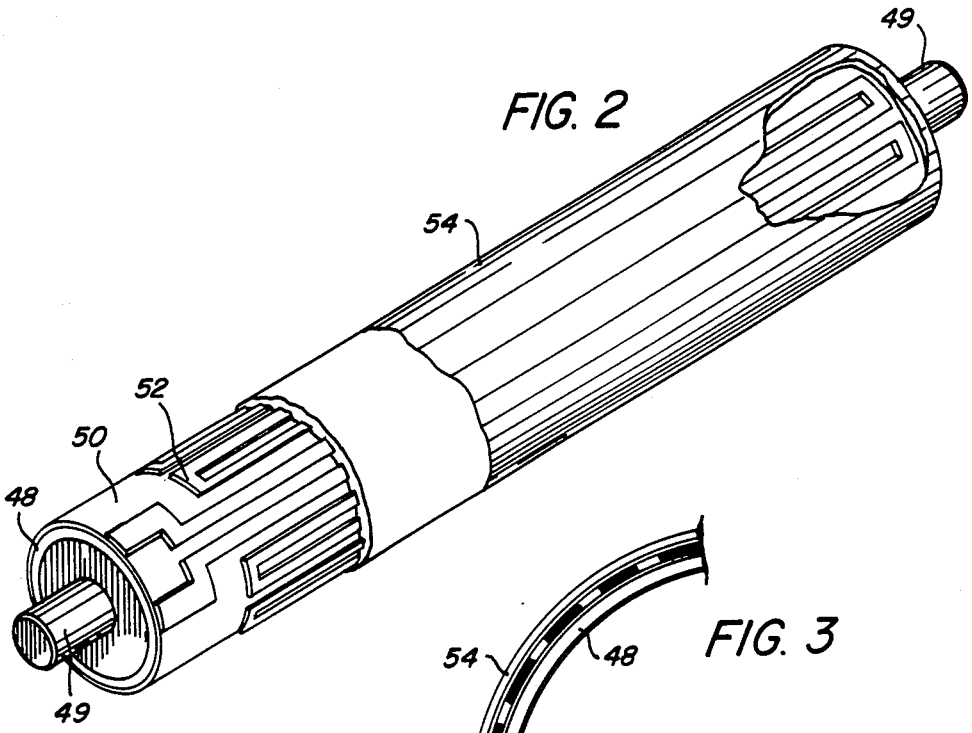
FIG. 2 is an isometric view of the instant-on fuser apparatus incorporated in FIG. 1 in accordance with the present invention.
Figure 3:
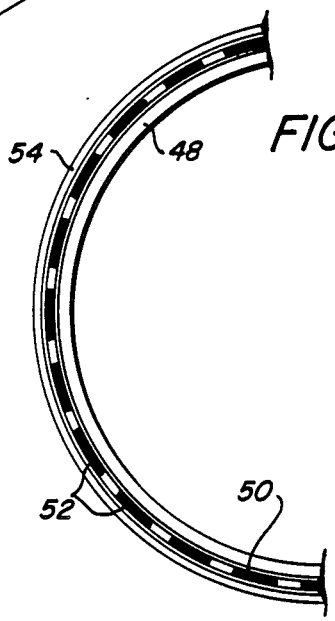
FIG. 3 is a cross-sectional view of the apparatus of FIG. 2

With reference to FIGS. 2 and 3, preferably supported on the filament wound cylindrical member 48 is a poly adhesive securing fiber glass backing 50. Supported on the fiber glass backing 50 is a suitable heating wire, printed circuit or photo etched circuit pattern 52. A suitable release agent 54 such as PFA or rubber covers the heating element. It should also be noted that a suitable high temperature adhesive may secure the fiber glass backing 50 to the cylindrical member 48. Also, any method of attaching a heating element to the fiber wound cylindrical member is contemplated.

Figure 4:
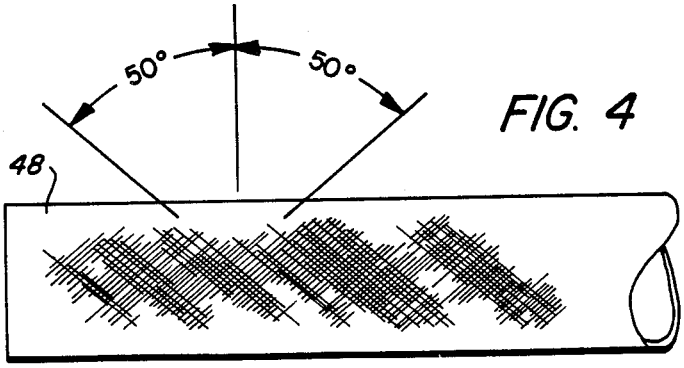
FIG. 4 is an illustration of the fiber weave of a fuser cylinder.

According to another aspect of the present invention, it is important for the fuser roll to have sufficient mechanical strength including hoop strength and beam strength. The hoop strength is the property of the fuser roll core material to resist inward radial pressure and beam strength is the property of the fuser roll core material to resist bending. With reference to FIG. 4, there is illustrated a filament wound tube or cylinder with the fibers wound at approximately 50° with respect to the longitudinal axis to provide sufficient mechanical strength. It should be noted that it is within the scope of the invention to weave fiber glass, carbon graphite, boron carbide, or any other fiber at a suitable angle to achieve sufficient mechanical strength.

In general, the higher the diameter of the cylindrical member 48, the larger a nip that can be formed and the slower the rotational speed. This allows a greater dwell time of the copy sheet in the nip of the fuser formed by the fuser roll 45 and pressure roll 47, dwell time being a function of surface speed plus the size or area of the nip. Higher diameter also means there is more recovery time, that is, the heat is held longer on the outside surface of the fuser roll and there is more time allowed for reheating. A difficulty, however, with a large diameter fuser roll or cylindrical member is the need for sufficient mechanical strength. In accordance with another aspect of the present invention, using a suitable choice of a fiber in the filament wound cylinder plus appropriate angle of fiber weave and suitable epoxy, cylindrical diameters of 3 to 4" are easily obtainable. Wall thicknesses are preferably less than 0.050 inches. In one embodiment, with a wall thickness less than 0.040 inches, fuser roll diameters of up to 4" have been used with fuser roll lengths up to 48".

To fabricate the fuser roll or cylindrical member of the present invention, it is necessary to first start with a filament wound cylinder or tube. The remaining portions of the system fabricated from the tube outward. The filament core structure can be wound on a mandrel using standard winding machines. The machine computers could be set or tailored to give proper winding angles (47° to 59°) to obtain the maximum mechanical strength. Each cylinder would be wound until a desired wall thickness is obtained, preferably 20 to 40 mils. At this point, fabrication would vary with the size of the roll, length, and production quantity. For short run large rolls, it is possible to consider winding a spiral heating element directly on the surface of the filament wound core. An additional layer of filament winding would be wound directly over the filament and the entire structure curred to suitable specifications. After curring, the composite structure would be ground to obtain a smooth outer surface for finishing.

Assuming standard xerographic fuser rolls are of 1" to 2" in diameter and approximately 16" long, high speed continuous filament winding can be considered. With this type of fabrication, the core or cylindrical member would be wound to a desired wall thickness and continuously fed down its mandrel to be cured, ground, and be cut to length. With is technique, a heater foil could be wrapped on the outside surface of the core and finished in the second operation.

Figure 5A:
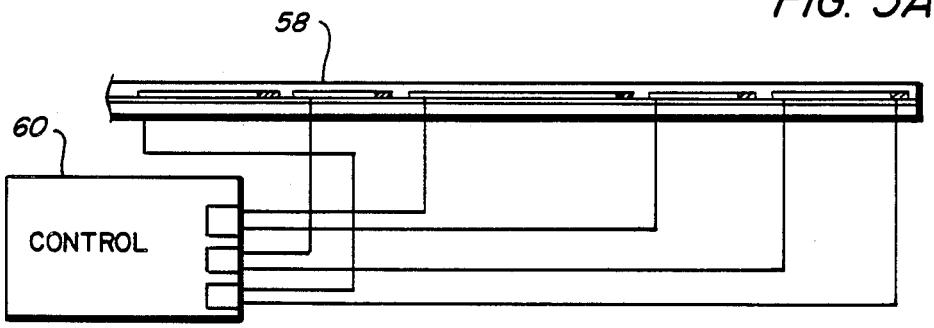
FIGS. 5A and 5B illustrate a segmented heating element to selectively fuse different sized copy sheets.
Figure 5B:
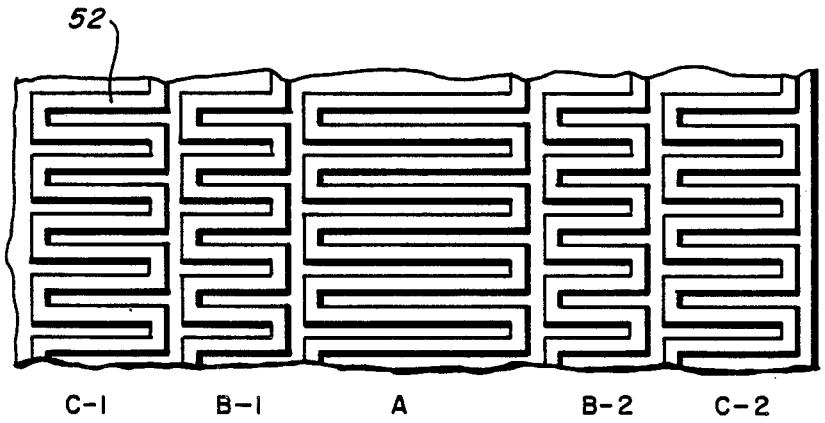

It is known to use a layer of metals on a fuser roll to distribute the heat energy. It is contemplated that using the filament wound roll there would be the option of eliminating the metal layer energy distributor altogether, or adding a minimum conductive layer by plating, spraying or any other cost effective technique. In accordance with another aspect of the present invention, with reference to FIG. 5aA and 5B, there is illustrated a selective fuser heating roll control. During the fabrication of the fuser roll, the heating element 58 can be laid down in separate sections such as illustrated in sections A, B1, and B2, and C1 and C2. Therefore, depending upon the size of the copy sheet to be fused, the appropriate heating element could be selectively activated by the control 60. For small copy sheets, only element A of the heating element would be activated. For larger size copy sheets, elements B1 and B2 along with A would be activated. Finally, for large size copy sheets, elements C1 and C2 along with A and B1, B2 would be selectively energized.

While there has been illustrated and described what is at present considered to be a preferred embodiment of the present invention, it will be appreciated that numerous changes and modifications are likely to occur to those skilled in the art, and it is intended in the appended claims to cover all those changes and modifications falling within the true spirit and scope of the present invention.

We claim:

1. In an electrostatic copying machine having pressure fusing apparatus of the type including an instantly heated fuser roll and a pressure back-up roll defining a nip through which support material bearing toner images is passed for fusing the toner images onto the support material, the fuser roll being raised approximately 120° C. in less than 10 seconds, the instantly heated fuser roll comprising:

a hollow, relatively thin, filament wound cylinder less than 40 mils thick, the cylinder having an outside and an inside surface, the cylinder enclosing ambient air;

a source of thermal energy affixed by a high temperature adhesive to the outside surface of said cylinder; and the source of thermal energy being a heating circuit element, the heating circuit element being embedded in the filament wound cylinder and patitioned into segments for selective application of the thermal energy.

2. The machine of claim 1 wherein the filament wound cylinder is glass, carbon graphite, or boron carbide.

* * * * *